United States Patent [19]

Fiedler

[11] 4,338,144

[45] Jul. 6, 1982

[54] METHOD OF PRODUCING SILICON-IRON SHEET MATERIAL WITH ANNEALING ATMOSPHERES OF NITROGEN AND HYDROGEN

[75] Inventor: Howard C. Fiedler, Schenectady, N.Y.

[73] Assignee: General Electric Company, Schenectady, N.Y.

[21] Appl. No.: 223,963

[22] Filed: Jan. 12, 1981

Related U.S. Application Data

[63] Continuation-in-part of Ser. No. 133,322, Mar. 24, 1980, abandoned.

[51] Int. Cl.[3] ..... H01F 1/04

[52] U.S. Cl. ..... 148/113; 148/111; 148/31.5

[58] Field of Search ..... 148/110, 111, 112, 113, 148/31.5; 427/127

[56] References Cited

U.S. PATENT DOCUMENTS

| | | | |
|---|---|---|---|
| 2,413,949 | 1/1947 | Broverman | 148/113 |
| 3,054,732 | 9/1972 | McQuade | 148/113 |
| 3,905,842 | 9/1975 | Grenoble | 148/111 |
| 3,905,843 | 9/1975 | Fiedler | 148/111 |
| 3,930,906 | 1/1976 | Irie et al. | 148/113 |
| 3,957,546 | 5/1976 | Fiedler | 148/111 |
| 4,010,050 | 3/1977 | Choby | 148/113 |
| 4,116,730 | 9/1978 | Arendt et al. | 148/113 |
| 4,168,169 | 9/1979 | Hasekorn | 148/31.5 |
| 4,173,502 | 11/1979 | Fiedler | 148/113 |
| 4,186,038 | 1/1980 | Maucione | 148/113 |

*Primary Examiner*—John P. Sheehan

*Attorney, Agent, or Firm*—Stephen S. Strunck; James C. Davis, Jr.; Joseph T. Cohen

[57] ABSTRACT

Silicon-iron sheet products having good magnetic properties can be produced from low nitrogen alloy sheet material by heating in a nitrogen-bearing hydrogen atmosphere to a temperature sufficient to effect secondary recrystallization and thereafter heating to a higher temperature in a hydrogen atmosphere to effect removal of residual carbon, nitrogen, and sulfur.

7 Claims, 2 Drawing Figures

METHOD OF PRODUCING SILICON-IRON SHEET MATERIAL WITH ANNEALING ATMOSPHERES OF NITROGEN AND HYDROGEN

CROSS-REFERENCE TO RELATED PATENT APPLICATION

This application is a continuation-in-part of copending application Ser. No. 133,322 filed Mar. 24, 1980, abandoned.

FIELD OF THE INVENTION

The present invention relates generally to the art of producing electrical steel and is more particularly concerned with a novel method of producing singly-oriented silicon-iron sheet from low nitrogen starting material by effecting secondary recrystallization in a nitrogen-bearing hydrogen atmosphere and thereafter effecting removal of residual carbon, nitrogen, and sulfur in a hydrogen atmosphere.

BACKGROUND OF THE INVENTION

The sheet materials to which this invention is directed are usually referred to in the art as grain oriented "electrical" silicon steels or, more properly, silicon-irons. These silicon-irons are ordinarily composed principally of iron alloyed with from about 2.2 to about 4.5% silicon, small amounts of carbon, and various elements added to develop desirable magnetic properties. These sheet materials are of the "cube-on-edge" type, i.e., more than about 70% of their crystal structure are oriented in the (110) [001] texture, as described in Miller Indices terms.

Such grain oriented silicon-iron sheet products are currently made commercially by a sequence which typically begins by casting an ingot and hot rolling the ingot to form a strip or a sheet-like configuration, commonly referred to as "hot-rolled band", less than about 0.150" in thickness. The hot-rolled band is then subjected to one or more cold rolling operations, with intermediate annealing when two or more cold rolling operations are employed, to effect at least a 50% reduction in thickness. The cold rolled sheet is then heat treated for decarburization and subsequently heat treated again for development of the cube-on-edge secondary recrystallization texture.

Herbert E. Grenoble, in U.S. Pat. No. 3,905,842, herein incorporated by reference, teaches that alloying silicon-iron with a small amount of boron, in critical proportion to the nitrogen content of the metal, enables preparation of oriented silicon-iron of good magnetic properties from material which would otherwise be incapable of the secondary recrystallization necessary to develop such properties.

Another related disclosure concerning the use of small, but critical, amounts of boron in the production of silicon-iron with consistently good magnetic properties is that of U.S. Pat. No. 3,957,546 to Howard C. Fiedler, herein incorporated by reference, which defines a process for cold rolling hot band directly to the final gauge while maintaining the boron-to-nitrogen and manganese-to-sulfur ratios in the metal within certain critical ranges.

In U.S. Pat. No. 4,010,050 to Edward G. Choby, Jr., herein incorporated by reference, there is disclosed a nitrogen-bearing base coating useful in providing a more thorough distribution of nitrogen during the annealing of aluminum nitride inhibited silicon steels thereby overcoming difficulties experienced theretofore with nitrogen-bearing annealing atmospheres.

In U.S. Pat. No. 4,186,038 to Carl M. Maucione, herein incorporated by reference, it is disclosed that the addition of a very small amount of boron to an adherent electrically insulating coating during the final anneal of silicon-iron results in the development of substantially better magnetic properties than would otherwise be produced and can cause secondary recrystallization to take place when otherwise it would not. It is taught that the thus-coated steel may be final annealed in hydrogen, or a mixture of nitrogen and hydrogen, by heating to a temperature sufficient to cause secondary recrystallization and thereafter, if desired, in the same atmosphere, the heating may be carried on up to a higher temperature to effect complete removal of residual carbon, sulfur, and nitrogen.

More recently, Howard C. Fiedler, in U.S. Pat. No. 4,173,502, herein incorporated by reference, teaches that silicon-iron having substantially improved magnetic properties can be obtained consistently by limiting the amount of boron in the cold rolled and decarburized intermediate starting sheet material to one particular range and by limiting the amount of boron in an electrically insulating coating on the sheet to another particular range. It is further disclosed that it is essential to the consistent development of the improved magnetic properties that the total boron in the alloy and the coating be limited to a certain maximum and that the nitrogen content of the alloy be proportioned in a particular manner to the total boron content of the alloy and the coating.

Boron-containing electrically insulating coatings, as referred to above, may be provided by slurry coating or by electrolytic processes disclosed, for example, in U.S. Pat. Nos. 3,054,732 and 4,116,730 to McQuade and Arendt et al., respectively; the entirety of which are herein incorporated by reference. McQuade teaches the electrolytic application of a uniform coating of magnesium hydroxide ($Mg(OH)_2$) about 0.5 mil thick to the sheet. Thereafter, the sheet coated by the McQuade process is dipped in an aqueous solution of boric acid or sodium borate or other suitable boron compound solution, which is preferably relatively dilute, i.e., containing of the order of 5 to 10 grams per liter of the boron compound, to incorporate the boron. Alternatively, as taught in Arendt et al., the boron-containing magnesium hydroxide coating may be applied electrolytically in one step. Arendt et al. further broadly teach that the final annealing of silicon iron coated by their method may be conducted by heating in hydrogen or a mixture of hydrogen and nitrogen to a temperature sufficient to cause secondary recrystallization and that thereafter the heating may be carried on up to a higher temperature in the same atmosphere, if desired, to insure complete removal of residual carbon, sulfur, and nitrogen.

SUMMARY OF THE INVENTION

It has been discovered that the variability in response of boron-bearing silicon-iron to the final anneal is related to the nitrogen content of the alloy and specifically to the solute nitrogen content. The solute nitrogen content is defined as the total nitrogen minus the nitrogen combined principally with boron.

The magnetic properties of silicon-irons having low and insufficient levels of solute nitrogen, i.e., less than about 20 parts per million, cannot be developed by prior art heat treatment methods to the extent possible for those silicon-irons containing higher and, therefore, sufficient levels of nitrogen. It has also been discovered that the beneficial effects on the magnetic properties from the addition of boron to the electrically insulating coatings normally applied to silicon-iron sheet materials cannot be obtained in the presence of insufficient levels of solute nitrogen. The undesirable effects of low levels of solute nitrogen are particularly manifest when the available sulfur content of the silicon-iron is relatively low; specifically, when the manganese to sulfur ratio is greater than about 2.1.

The new heat treatment method of this invention, however, permits development of magnetic properties in silicon-irons having low levels of solute nitrogen which are substantially equivalent to those of silicon-irons having higher and sufficient levels of nitrogen. Additionally, this new method permits realization of the beneficial effects of boron additions to the electrically insulating coatings.

Briefly, the method of this invention comprises the steps of first providing fine grained, primary recrystallized, silicon-iron intermediate product sheet material containing from about 2.2% to about 4.5% silicon, boron, and manganese up to about 0.10%. The intermediate product material is further characterized by having a manganese-to-sulfur ratio of at least 2.1 and less than about 20 parts per million solute nitrogen. Thereafter, an electrically insulating boron-containing adherent coating is applied to the material. The coated material is then final annealed in accordance with the method of this invention by heating in a nitrogen-bearing hydrogen atmosphere, having at least 20 volume percent nitrogen, to a temperature sufficient to develop a secondary recrystallization texture. As part of this final anneal, the temperature is then increased and the material is held in a hydrogen atmosphere for a period sufficient to effect purification by the removal of substantially all carbon, nitrogen, and sulfur.

The term "final anneal" encompasses heat treatment initiated to develop the cube-on-edge texture in these silicon-irons and includes any subsequent heating for purification by removal of residual elements such as carbon, sulfur, and nitrogen.

BRIEF DESCRIPTION OF THE DRAWINGS

The invention is more clearly understood from the following description in conjunction with the accompanying drawings wherein.

DETAILED DESCRIPTION OF THE INVENTION

Figure 2:
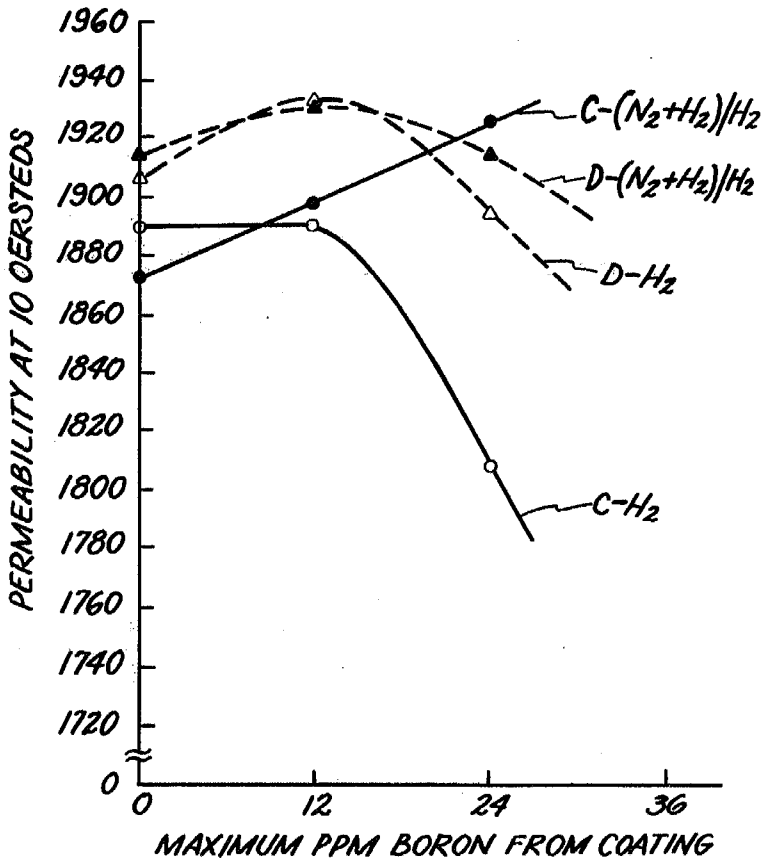
FIG. 2 is a graph similar to FIG. 1 except that the permeability property of two additional heats of silicon-iron is presented.

The starting material for the practice of the method of this invention is fine-grained, decarburized, and primary recrystallized silicon-iron intermediate product sheet material produced by any of the several methods known to those skilled in the art. The material is further characterized by having from about 2.2% to about 4.5% silicon, boron, manganese up to about 0.10%, a manganese-to-sulfur ratio of at least 2.1, less than about 20 parts per million (ppm) solute nitrogen and other incidental alloying elements or impurity elements. The intermediate product is further processed to provide an electrically insulating boron-containing coating in preparation for the final texture-developing anneal. The coating step may be accomplished as described in the previously cited U.S. Pat. Nos. 3,054,732 and 4,116,730.

As used above and elsewhere in this specification and in the appended claims, the term "solute nitrogen" means and refers to that nitrogen in the silicon-iron sheet material other than the nitrogen existing in the form of stable nitrides of boron, titanium, aluminum and the like, i.e., uncombined nitrogen in stoichiometric excess of the stable nitride forming elements present in the silicon-iron alloy. To a first but sufficiently accurate approximation for the purposes of this invention, solute nitrogen may be calculated by multiplying the boron content determined by conventional macrochemical analysis by the ratio (1.3) of the atomic weight of nitrogen (14) to the atomic weight of boron (10.8) and subtracting that value from the nitrogen content determined by conventional macrochemical analysis such as vacuum fusion.

Then, in accordance with the method of this invention, and thus-coated sheet is heated at a predetermined rate in a nitrogen-bearing hydrogen atmosphere to cause secondary grain growth, i.e., secondary recrystallization. The proportion of nitrogen in this atmosphere has not been found to be critical in terms of the magnetic properties of the ultimate secondarily recrystallized product, but at least about 20 volume percent nitrogen must be present. As the temperature is raised at about 50° C. per hour secondary grain growth begins at about 950° C. and is completed at about 1050° C. Once secondary recrystallization has been effected, the nitrogen is no longer beneficial and, along with the other residual elements commonly found in all steels (e.g., carbon and sulfur), is actually detrimental to the development of optimum magnetic properties since these residuals inhibit domain motion. Therefore, the sheet material is purified of these residuals by heating to a yet higher temperature (about 1175° C.) and held there for a predetermined time (about 3 hours) to allow these residuals to diffuse out of the silicon-iron. It is particularly important that only a hydrogen atmosphere be used in the purification step and not the nitrogen-bearing hydrogen atmosphere with respect to the silicon-irons to which this invention pertains in order to insure attainment of a low content of residuals; especially nitrogen.

The following illustrative, but not limiting, example of the novel process as actually carried out with the new results indicated above will further inform those skilled in the art of the nature and special utility of this invention.

EXAMPLE

Four laboratory heats were melted in an air induction furnace, three under an argon cover and the fourth, which had the highest nitrogen content, under a nitrogen cover. In addition to iron, the heats contained 3.1% silicon, 0.016% sulfur, and other elements in the amounts set forth in Table I wherein N* is the solute nitrogen content calculated in the manner discussed above.

TABLE I

| HEAT | % C | % Mn | % Sn | % Cu | % Cr | B ppm | N ppm | N* ppm |
|---|---|---|---|---|---|---|---|---|
| A | 0.039 | 0.035 | 0.010 | 0.30 | 0.030 | 13 | 37 | 20 |
| B | 0.037 | 0.034 | 0.010 | 0.30 | 0.030 | 12 | 83 | 67 |
| C | 0.037 | 0.036 | 0.047 | 0.10 | 0.035 | 10 | 27 | 14 |
| D | 0.033 | 0.036 | 0.042 | 0.10 | 0.035 | 8 | 42 | 32 |

Slices 1.75 inch thick were cut from ingots cast from these melts and were hot rolled from 1250° C. in six passes to a thickness of about 90 mils. Following pickling, the hot band pieces were heat treated at 950° C., the time between 930° and 950° C. being about three minutes. The hot band pieces were then cold rolled directly to 10.8 mils and in Epstein-size strips were decarburized to 0.002–0.005% carbon in hydrogen with a dew point of 70° F. The strips were then roller coated with magnesium hydroxide and boron additions were made to some of the coatings by brushing with dilute solutions of boric acid.

Some of the thus-coated strips, the control specimens, were final annealed in a conventional manner by heating in hydrogen at 40° C. per hour from 800° C. to 1175° C. and held at 1175° C. for three hours to effect removal of carbon, nitrogen and sulfur. The remaining specimens were final annealed by method of this invention by heating in a 55% nitrogen—45% hydrogen atmosphere at 40° C. per hour from 800° C. to 1050° C. to develop the cube-on-edge texture and thereafter were heated in a hydrogen atmosphere to 1175° C. and held thereat for three hours to effect removal of carbon, nitrogen and sulfur. The magnetic properties of the resulting specimens are set forth in Table II and the permeabilities are presented in graphical form in FIGS. 1 and 2.

Figure 1:
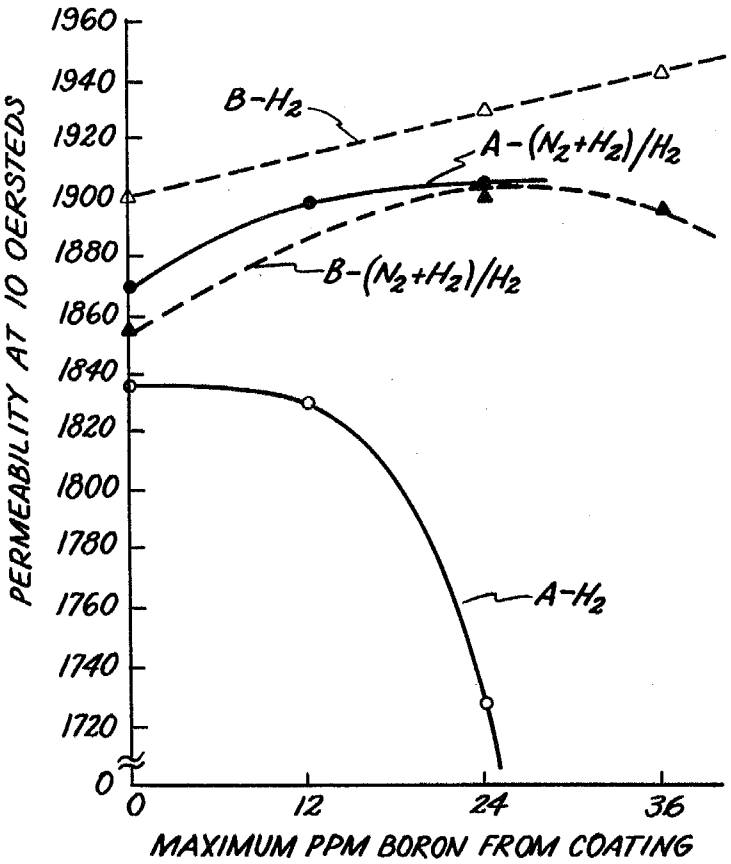
FIG. 1 is a graph of permeability versus the maximum boron available from an electrically insulating coating for two heats of silicon-iron, essentially identical in composition except for nitrogen content, heat treated either in accordance with the method of this invention or in a conventional manner.

FIGS. 1 and 2 show that the heats (A and C) with the lower solute nitrogen contents had lower permeabilities than the heats (B and D) with the higher solute nitrogen content when there was no boron available from the coating and the final anneal was conducted in the conventional manner in a 100% hydrogen atmosphere. Also, the permeability of heats A and C unexpectedly decreased with increasing availability of boron from the coating when the final anneal was conducted in the conventional manner. However, and in contrast, when the final anneal of heats A and C was conducted in accordance with the teachings of this invention, the permeabilities were markedly improved with increasing availability of boron from the coating.

TABLE II

MAGNETIC PROPERTIES AFTER FINAL ANNEAL

| | | Maximum ppm Boron Available from Coating | | | | | | | |
|---|---|---|---|---|---|---|---|---|---|
| | Final Anneal | 0 | | 12 | | 24 | | 36 | |
| Heat | Atmosphere(s) | mwpp[1] | 10H[2] | mwpp | 10H | mwpp | 10H | mwpp | 10H |
| A | $H_2$ | 804 | 1837 | 793 | 1831 | 949 | 1728 | — | — |
| A | $(N_2 + H_2)/H_2$ | 770 | 1870 | 722 | 1898 | 701 | 1904 | — | — |
| B | $H_2$ | 739 | 1902 | — | — | 676 | 1931 | 655 | 1944 |
| B | $(N_2 + H_2)/H_2$ | 768 | 1856 | — | — | 713 | 1902 | 721 | 1897 |
| C | $H_2$ | 691 | 1890 | 677 | 1890 | 770 | 1809 | — | — |
| C | $(N_2 + H_2)/H_2$ | 699 | 1873 | 691 | 1899 | 655 | 1926 | — | — |
| D | $H_2$ | 683 | 1907 | 644 | 1934 | 662 | 1895 | — | — |
| D | $(N_2 + H_2)/H_2$ | 683 | 1915 | 661 | 1930 | 656 | 1915 | — | — |

[1]Core loss in milliwatts per pound at 17 kilogauss
[2]Permeability at 10 Oersteds Addition of small amounts of boron are taught by the prior art to be beneficial to the development of good magnetic properties. Thus the poor magnetic properties observed in the low solute nitrogen content heats (A and C) and the further decreases caused by increasing boron availability from the coating, when the final anneal was conducted conventionally in a 100% hydrogen atmosphere, were not expected based on the prior art teachings; especially the above-cited U.S. Pat. Nos. 4,186,038 and 4,116,730 to Maucione and Arendt et al., respectively.

Grain growth inhibition in this type of silicon-iron, a prerequisite for secondary recrystallization, requires the presence of nitrogen both as a solute and as boron nitride. Although boron diffusing into the alloy and forming boron nitride promotes grain growth inhibition, the data of the Example surprisingly show that the benefits are eventually outweighed by depletion of the alloy of solute nitrogen. Heats A and C are sufficiently low in solute nitrogen that given the loss of nitrogen from the pack anneal in hydrogen, even the smallest addition of boron either produced no improvement or was harmful. Thus this invention shows that the prior art teachings that boron diffusing from the coating into the alloy to form particles of boron nitride is beneficial, should be modified to note that diffused boron is beneficial provided the alloy is not left with an insufficient amount of solute nitrogen from boron combining with nitrogen.

Further, by comparing the magnetic properties of the heats (B and D) with the high solute nitrogen contents it may be observed, from FIGS. 1 and 2, that a final anneal conducted in accordance with the method of this invention is not advantageous to silicon-irons having a high solute nitrogen content, i.e., greater than about 20 ppm, and may even be deleterious.

More specifically, the permeability of the heat with the highest solute nitrogen content (heat B) had a lower permeability when final annealed in accordance with the teachings of this invention, compared to a final anneal conducted in a 100% hydrogen atmosphere, with no boron available from the coating and with increasing boron availability. The permeability of heat D, which had less solute nitrogen than heat B, but more than heats A and C, was about the same irrespective of whether the final anneal was conducted conventionally in a 100% hydrogen atmosphere or in accordance with the teachings of this invention.

Thus, the Example shows that as the nitrogen content of the silicon-iron decreases, the difference in magnetic properties obtained by conducting the final anneal in accordance with this invention, or conventionally in hydrogen, decreases and then reverses with the benefits obtained by final annealing in accordance with the teachings of this invention accruing when the solute nitrogen content decreases below about 20 parts per million.

This decrease and reversal in the magnetic properties as a function of solute nitrogen content and method of final anneal is not taught by or predictable from the prior art, especially the above-cited U.S. Pat. Nos. 4,186,038 and 4,116,730 and 4,010,050 to Maucione, Arendt et al., and Choby, Jr., respectively. The teachings of all three patents imply that nitrogen-hydrogen final annealing atmospheres are not detrimental to the development of the magnetic properties of silicon irons irrespective of the chemical composition of the silicon-irons and irrespective of whether boron nitrides (Maucione and Arendt et al.) or aluminum nitrides (Choby, Jr.) are the operating grain growth inhibitors.

Throughout this specification and the appended claims, wherever proportions or percentages or parts are recited it is the weight basis to which reference is made unless otherwise indicated. In the case of the annealing atmospheres, it is the percentage by volume to which reference is made in specific terms.

Although this invention has been particularly shown and described with reference to the best mode thereof, it will be understood by those skilled in the art that various changes in form and detail may be made therein without departing from the true spirit and scope of the invention as described by the appended claims.

I claim as my invention:

1. The method of producing grain oriented silicon-iron sheet comprising the steps of:

(a) providing fine-grained, decarburized, and primary recrystallized silicon-iron intermediate product sheet material, said material containing from about 2.2% to about 4.5% silicon, boron, manganese up to about 0.10%, said material having a manganese-to-sulfur ratio of at least 2.1 and less than about 20 parts per million solute nitrogen;

(b) covering said sheet with an electrically insulating boron-containing adherent coating;

(c) heating said coated sheet in a first atmosphere comprising hydrogen and at least about 20 volume percent nitrogen to a first temperature developing thereby a cube-on-edge secondary recrystallization texture in said sheet; and (d) increasing the temperature of said sheet to a second temperature and holding said sheet at said second temperature in a second atmosphere consisting essentially of hydrogen for a predetermined time effecting thereby substantial removal of carbon, sulfur and nitrogen.

2. The method of claim 1 wherein said nitrogen in said first atmosphere is about 55% by volume.

3. The method of claim 1 wherein the boron content of said sheet material is from about 8 parts per million to about 13 parts per million and the amount of boron in said adherent coating available to said sheet is less than about 12 parts per million.

4. The method of claim 1 wherein the boron content of said sheet is about 12 parts per million and the boron in said adherent coating available to said sheet is between about 12 and 36 parts per million.

5. The method of claim 1 in which the total amount of boron in said sheet and the boron in said adherent coating available to said sheet is between about 20 and 50 parts per million.

6. The method of claim 1 wherein said first temperature is about 1050° C.

7. The method of claim 1 wherein said second temperature is about 1175° C. and said predetermined time is about three hours.

* * * * *